US010962277B2

(12) United States Patent
De Luca et al.

(10) Patent No.: US 10,962,277 B2
(45) Date of Patent: Mar. 30, 2021

(54) REFRIGERATOR APPLIANCE HAVING AT LEAST ONE INNER PLASTIC LINER AND METHOD FOR MANUFACTURING THE LINER

(71) Applicant: ELECTROLUX APPLIANCES AKTIEBOLAG, Stockholm (SE)

(72) Inventors: Gilda De Luca, Porcia (IT); Alfredo Bassan, Porcia (IT); Corrado Cecchini, Porcia (IT); Massimo Sanita, Porcia (IT); Luca Fabbro, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/770,583

(22) PCT Filed: Nov. 25, 2015

(86) PCT No.: PCT/EP2015/077610

§ 371 (c)(1),
(2) Date: Apr. 24, 2018

(87) PCT Pub. No.: WO2017/088913

PCT Pub. Date: Jun. 1, 2017

(65) Prior Publication Data

US 2018/0313600 A1 Nov. 1, 2018

(51) Int. Cl.
*F25D 23/06* (2006.01)
*C08F 297/08* (2006.01)
(Continued)

(52) U.S. Cl.
CPC ..... *F25D 23/066* (2013.01)

(58) Field of Classification Search
CPC ..... F25D 23/066; C08F 297/08; C08L 23/12; C08L 23/14; C08L 53/00; C08K 7/04
See application file for complete search history.

(56) References Cited

U.S. PATENT DOCUMENTS 4,990,554 A * 2/1991 Nomura ..... C08K 7/04 524/423
6,306,973 B1 * 10/2001 Takaoka ..... C08F 297/08 525/240

(Continued)

FOREIGN PATENT DOCUMENTS

AU 2005201073 4/2005
AU 2005201073 C1 * 8/2008 ..... C08F 10/00

(Continued)

OTHER PUBLICATIONS

International Search Report for PCT/EP2015/077610, dated Jul. 28, 2016, 2 pages.

(Continued)

*Primary Examiner* — Bijan Ahvazi
(74) *Attorney, Agent, or Firm* — Pearne & Gordon LLP

(57) ABSTRACT

It is provided a refrigerator appliance (1) having at least one internal liner (2), in particular a cabinet liner or a door liner, defining an inner compartment (3) and made of a polypropylene-based material comprising a propylene-ethylene copolymer having a main polypropylene chain with ethylene units arranged along the polypropylene chain; and at least one lamellar or fibrolamellar filler. The material makes it possible to effectively manufacture the liner (2) by thermoforming.

17 Claims, 6 Drawing Sheets

(51) Int. Cl.
*C08L 23/14* (2006.01)
*C08L 53/00* (2006.01)

(56) References Cited

U.S. PATENT DOCUMENTS

| | | | | |
|---|---|---|---|---|
| 2005/0070673 | A1* | 3/2005 | Novak | B29C 51/002 525/333.9 |
| 2011/0098463 | A1* | 4/2011 | Yoshitani | C08B 13/00 536/32 |

FOREIGN PATENT DOCUMENTS

| | | | | |
|---|---|---|---|---|
| CN | 100349940 | | 11/2007 | |
| EP | 0206034 | | 1/1992 | |
| EP | 1026184 | | 8/2000 | |
| EP | 1026184 | B1 * | 5/2004 | C08F 297/08 |
| EP | 2295470 | | 3/2011 | |

OTHER PUBLICATIONS

Chinese Office action for application No. 201580084457.8 dated Apr. 14, 2020, 9 pages.
European Office action for application No. 15798477.4 dated Apr. 9, 2020, 5 pages.

* cited by examiner

REFRIGERATOR APPLIANCE HAVING AT LEAST ONE INNER PLASTIC LINER AND METHOD FOR MANUFACTURING THE LINER

The present invention relates to a refrigerator appliance having at least one plastic liner, in particular a cabinet liner or a door liner, defining an inner compartment, and to a method for manufacturing such a refrigerator appliance and specifically the liner.

Refrigerator appliances (refrigerators and freezers) have one or more internal compartments, formed in the main refrigerator cabinet and possibly in the door(s) and usually defined by plastic liners.

Refrigerator cabinet and door liners commonly have a relatively complex shape, in order to provide support for shelves and to house electrical and electronic components such as fans, switches, lamps, etc. Thus, refrigerator liners are advantageously manufactured by thermoforming, especially vacuum forming.

Thermoforming is a manufacturing process where a plastic sheet is heated up to a forming temperature, formed into a specific shape in a mold, and trimmed to create a product. The sheet is heated (for example, in an oven) to a temperature such that the sheet can be stretched into or onto a mold and cooled to a finished shape. In vacuum forming, the sheet of plastic (heated to the forming temperature) is forced against the mold by a vacuum (suction of air).

In the refrigerator appliances field, thermoforming is the preferred method to shape cabinet and door liners, since it is very cost-effective in comparison with other technologies like injection molding, and permits to obtain also very complex objects. However, thermoforming restricts the plastic material choice, since only a few polymer materials can be used for thermoforming and in particular for vacuum forming.

Suitable polymers, widely used in the refrigerator industry, are HIPS (high-impact polystyrene) and ABS (acrylonitrile-butadiene-styrene).

HIPS and ABS are in fact amorphous polymers (both including butadiene rubber) having a wide processing temperature window (temperature range, above the glass transition temperature and below the melting temperature, in which the polymer is in a substantially soft rubbery phase and can be effectively formed in the desired shape) and thus they can be thermoformed easily and without requiring a strict and careful temperature control.

While ABS has a better thermoformability, it has also a higher cost; hence, HIPS, which is however suitable to produce complex-shape articles and highly detailed parts, is currently the most used polymers for refrigerator liners.

The main drawback of HIPS is a relatively low resistance to chemical aggression by detergents and oils. Even if HIPS for liners has an improved stress cracking resistance compared to conventional high impact polystyrene, its susceptibility to aggression by common chemical agents is nevertheless notable.

Moreover, fluctuations in availability of styrene on the market cause constant variation of purchasing cost, higher than any standard polyolefin. At the same time the vertical integration required for combining competitively polystyrenic backbone with polybutadiene rubber (as already remarked, both ABS and HIPS are easily thermoformed because of the presence of butadiene rubber inside the polymeric structure) has caused in the recent past a reduction in the number of polymer manufacturers and suppliers.

In recent years, the possibility to replace HIPS with other polymers in the manufacturing of refrigerator liners has been investigated. In particular, polypropylene materials have been extensively tested.

Polypropylene (PP), precisely isotactic polypropylene, is a semi-crystalline polymer having a high degree of crystallinity. It is a low cost commodity plastic, widely available on the market and used in high volumes for many applications. In comparison with HIPS, PP has a significantly lower cost and better chemical resistance to common food stuffs like vegetable oils.

However, applicant found that the high degree of crystallinity of PP is the main reason why PP is very challenging for thermoforming. Even if PP is widely and successfully used in many thin-gage thermoforming applications (requiring however a strict and careful control of the operating temperature), there are still many unsolved problems in the production of large and deep parts (like inner liner for refrigerators or freezers) with competitive cycle times.

In fact PP is characterized by a very narrow thermoforming window and a poor strength at high temperature. PP changes rapidly from a brittle, glass-like condition to a rubbery phase and then changes abruptly from the rubbery solid to a melted liquid in a few degrees: thermoforming can be performed only within a very narrow temperature processing window, corresponding to the rubbery phase. Moreover, the rubbery solid has a poor melt strength.

The processing cycle time for obtaining the inner liner of a refrigerator or freezer (i.e. the time required for producing an inner liner of a refrigerator or freezer) using PP is significantly longer in comparison with using HIPS, because of the higher heating energy required to bring the material to the forming temperature (it is known that, generally speaking, the amount of energy required to heat a crystalline or semi-crystalline polymer materials up to the forming temperature is dramatically higher when compared with amorphous polymers). For the same reason, a longer cooling step is also required in order to remove the additional energy added during the heating.

Again as a consequence of the crystalline nature of PP, only a limited control is possible on the final product shape, resulting in an uneven wall thickness and distortion of the shaped parts.

Attempts to improve thermoformability of PP have been tried by controlling the crystallinity of the polymer. Extensive studies on nucleants for PP indicate that controlling the crystallization rate of thermoformed parts improve thickness homogeneity and reduce issues related to torn or distorted parts.

For example, EP0589033 discloses an improved thermoformable polypropylene-based sheet comprising an effective amount of a beta-spherulite nucleating agent. Mineral fillers, such us titanium dioxide or calcium carbonate, are added as opacifiers in an amount of about 0.5-5%. However, since the nucleant agent is a chemical dye (quinacridone colorant permanent Red E3B), it cannot be used for white refrigerator liners. Moreover, the enhanced crystallization rate is not adequate to manage the supplementary energy request of PP in comparison with HIPS; therefore production time cycles with beta nucleated PP are not competitive with HIPS in refrigerator liners production.

A different approach is followed by U.S. Pat. No. 4,842,742, which discloses a method of forming relatively large objects, such as refrigerator liners, by a solid phase forming process from crystalline-type synthetic resins, such as polypropylene. In particular, a PP sheet is stretched inside a female mold by means of a punch. The configuration of the punch does not match the shape of the female mold, and the configuration of the punch differs from that of the final product. The final configuration of the sheet is determined by the configuration of the female mold against which the sheet is urged, in the final step of the forming operation, by vacuum applied inside the female mold and by high pressure fluid acting against the inner surface thereof. This procedure is described to be effective in ensuring good material distribution throughout the whole final object (liner): female molds can in fact produce highly detailed parts and good thickness homogeneity.

The above described method requires using female molds, which are currently only a marginal part of the whole liners production, while male molds are largely used in the refrigerator appliance industry. In fact female molds are typically more expensive than male molds. Moreover, in the female mold technology, the mold surface produces the exterior surface of the cabinet inner liner, corresponding to the area in contact with the insulation foam of the refrigerator; but plug assist marks may appear on such a surface, which should be indeed avoided.

On the other side, male molds generally allow a more precise dimensional control to be achieved, and also multi-cavity parts to be easily produced. For these reasons, it would be desirable to develop an effective male mold technology for PP thermoforming.

However, use of male molds leads to additional problems and a PP material which proves effective with the female mold thermoforming technology may results unsuitable if thermoforming is performed by means of male molds. In fact, when male molds are used, the material is subjected to greater deformation, because the material has to be first stretched to cover the mold outer surface, and then retracts to adhere to the mold surface. With female molds, the material sheet is directly deformed inside the mold cavity, therefore the material is less stressed.

Another problem is the process time and in particular the time requested for the cooling step. As already remarked, the material thermal behavior, in particular thermal conductivity, affects the way the material gets cold and hence the cooling time.

To sum up, thermoforming of PP materials remains extremely difficult and in the field it is not yet known a fully satisfactory method which permits to effectively replace known materials such as HIPS and ABS in the manufacture of refrigerator inner liners by thermoforming.

It is an object of the present invention to overcome the aforementioned drawbacks, in particular by providing a refrigerator appliance with at least one inner plastic liner manufactured by thermoforming in an efficient and cost-effective manner.

It is a specific object of the invention to provide an efficient and cost-effective method for manufacturing a refrigerator cabinet or door liner by thermoforming.

It is a further specific object of the invention to provide a polymer material suitable for replacing traditional materials such as HIPS and ABS in the manufacture of refrigerator inner liners by thermoforming.

Accordingly, there is provided a refrigerator appliance having at least one plastic liner, in particular a cabinet liner or a door liner, defining an inner compartment, as claimed in claim 1; and a method for manufacturing a liner of a refrigerator appliance as defined in claim 15.

Preferred aspects and further features of the invention are claimed in the dependent claims.

In general terms, the present invention provides an improved polypropylene-based material for thermoforming plastic liners (cabinet liners and door liners) of refrigerator appliances. The material basically comprises a polypropylene copolymer (namely, a propylene-ethylene copolymer) compounded with a lamellar or fibrolamellar filler, such as talc.

Moreover the invention provides an improved thermoforming method for the manufacture of refrigerator appliance liners, wherein male molds are used.

The invention achieves several advantages with respect to the refrigerator liners thermoforming methods of the prior art.

First, the invention permits the use of a base material which is less expensive than HIPS and ABS, but which is also suitable for thermoforming. The to polypropylene-based material of the invention is actually compounded so as to be thermoformed efficiently even in a thermoforming process with male molds.

In particular, the invention allows refrigerator liners to be thermoformed substantially at the same level of productivity with respect to the known materials.

Moreover, the material used according to the invention has an excellent resistance to foodstuff and detergents.

As already remarked, PP typically features a limited range of temperature for thermoforming, and the rubbery heated polymer requires a careful control of the sheet temperature even for forming thin-gage parts.

According to the invention, thermoforming characteristics of PP are improved by producing chemical modifications of the PP backbone, in particular obtained by copolymerization with ethylene fractions, i.e. by introducing ethylene units into the polypropylene main chain; and by adding one or more fillers having a specific structure, i.e. a lamellar or fibrolamellar structure, preferably talc.

The resulting polypropylene copolymers (propylene-ethylene copolymers) have lower crystallization temperatures and better sag resistance compared to common PP homopolymers.

In fact, PP copolymers have a lower tendency to crystallization and thus a lower melting temperature, resulting in an improved thermoformability, in comparison with PP homopolymers.

The ethylenic co-monomer units can be inserted randomly with irregular patterns along the main polypropylene chain (resulting in a random copolymer), or be arranged in blocks with regular patterns (resulting in a block copolymer).

Trials have been run with both random and block copolymers. The best results were achieved with random copolymers, but also block copolymers proved effective.

As mentioned above, the random pattern is usually called "random copolymer"; the irregular presence of ethylene units along the main propylenic chain reduces the tendency to crystallize lowering the melting temperature and improving the thermoformability in comparison with the polypropylene homopolymer. Random co-polymers have also improved impact strength with respect to the polypropylene homopolymer.

Preferably, the ethylene content in the PP copolymers ranges between about 1% and about 8%, preferably between about 2% and about 5%.

Insertion of ethylene units in the propylene molecular chain results in a significant reduction of the crystallinity degree as well as the melting point of the polymers.

The effect is significantly greater with random copolymer (in which ethylene units are inserted randomly, i.e. without a predetermined order, along the polypropylene chain).

For example, FIGS. 1 and 2 shows the decrease of melting point, crystallization temperature and crystallization content in copolymers having different and increasing ethylene content (ethylene content is estimated by means of Infrared Spectroscopy—FTIR, and Nuclear Magnetic Resonance spectroscopy—NMR, respectively), in comparison with polypropylene homopolymer (ethylene content equal to zero).

FIG. 3 shows the corresponding crystallinity and the estimated processing window (thermoforming window) as a function of the ethylene content in the polypropylene backbone.

FIG. 4 shows the results of Dynamic mechanical analysis (DMA) performed on HIPS, random ethylene-propylene copolymer and homo-polypropylene at temperature above 90° C., when the thermoforming process takes place. In particular, FIG. 4 is a graphic of the rubbery behavior of the tested polymers: HIPS has a relatively long and roughly flat plateau from 104°/110° C. up to the melting point. On the other side polypropylene homo-polymer is too stiff for thermoforming along most of the temperature range and its curve, representing the rubbery behavior, starts to decline at roughly 153° C. with a step-wise reduction up to the melting point. Random polypropylene co-polymer has satisfactory intermediate properties between the outstanding properties of HIPS and the poor characteristics of homo-polypropylene. The rubbery behavior of the polypropylene copolymer is suitable for thermoforming after 132° C. and this material can be formed up to temperature close to the melting point. This modification of the rubbery behavior is the feature that is exploited according to the present invention for thermoforming refrigerator appliances liners.

In accordance with the invention, the polypropylene copolymer including (preferably random) ethylene units is compounded with at least one filler with high aspect ratio (length vs thickness or diameter ratio) such as lamellar or fibrolamellar fillers, in order to increase the poor thermal conductivity and diffusivity of the polymer and improve the mechanical properties of the resulting material when heated.

In particular, the fillers, specifically selected to have a lamellar or fibrolamellar structure, are added in order to increase stiffness of the heated sheet at the process temperature, to increase resistance to sagging, and to improve mechanical properties at room temperature.

Lamellar or fibrolamellar fillers are formed by thin particles having a substantially plate shape (i.e. a platelet shape). More precisely, lamellar or fibrolamellar fillers have particles consisting of elementary leaves (possibly arranged to form stacks) with a thin, plate-like structure.

Lamellar and fibrolamellar fillers have at least one dimension (thickness), possibly two dimensions, on the nanometric scale (i.e. sized up to 100 nanometers).

Suitable fillers are talc, kaolin, mica, glass flakes, nanoclays, montmorillonite and bentonite, graphite, aluminum nitride, and boron nitride.

Use of talc is preferred, since it provides the better results.

The filler particles surface can be modified in order to increase interactions with the polymer molecules, for example by using a silane treatment.

One or more fillers (in combination with each others) can be used.

Addition of at least one lamellar or fibrolamellar filler improves the thermal properties of the PP copolymer and accordingly contribute to reduce the time cycles and improve the process capability, in particular by influencing the heating and cooling steps of the thermoforming process.

As already mentioned, polypropylene as well as other crystalline polymers require more energy than amorphous polymers for increasing their temperature to the processing rubbery phase required for vacuum forming. The surplus energy required by PP causes longer cycle times, both in the heating and in the cooling steps of the process, in comparison with standard HIPS processes.

It has been discovered that lamellar or fibrolamellar fillers are significantly more effective than granular fillers to improve thermal properties (in particular thermal conductivity and thermal diffusivity) of a PP material. In comparison to a granular filler, the same amount of a lamellar/fibrolamellar filler results in a much higher increase in thermal conductivity and thermal diffusivity of the PP material; and in order to achieve the same result of a given amount of a granular filler, a significantly lower amount of lamellar/fibrolamellar filler is needed.

It has also been observed that lamellar/fibrolamellar fillers have an important effect on the mechanical properties of the PP polymers; in particular, addition of lamellar/fibrolamellar fillers to PP copolymers results in a significant increase of sag resistance and drawability, which is not obtained by using instead other fillers.

For example, comparative tests have been carried out on a PP copolymer (without fillers), on the same copolymer compounded with a granular filer (20% w/w calcium carbonate), and on the same copolymer compounded with the same amount of a lamellar filler (talc). A clear difference has been reported between the talc filled material and the calcium carbonate filled material, in terms of better formability and sag resistance. In fact, PP materials filled with calcium carbonate give rise to sags during heating and are subject to thickness variations and stretching marks during the forming phase; on the other side, PP materials compounded with lamellar talc are very resistant to sagging and thin sheets can be thermoformed at even high draw without lacerations/damages.

FIG. 5 shows the effect of a filler (talc) selected according to the invention on crystallization temperature of a polypropylene-ethylene copolymer. The two graphs of FIG. 5 show the behavior of the heat flow transmitted (W/g) by the material as a consequence of its heating, with respect to the temperature.

It can be seen that talc increases the crystallization temperature of the polypropylene-ethylene copolymer, which reaches the maximum recrystallization degree at 124° C., while the polypropylene-ethylene copolymer without the filler at 117° C.; therefore the polypropylene-ethylene copolymer filled with talc becomes rigid before the not-filled polypropylene-ethylene copolymer. Therefore the cooling time of the polypropylene-ethylene copolymer filled with talc is lower than the cooling time of the polypropylene-ethylene copolymer without the filler, which reduces the overall cycle-time if polypropylene-ethylene copolymer filled with talc is used.

Talc actually promotes crystallization of polypropylene, since the filler acts as alpha nucleating agents. In the presence of talc, mechanical properties and stiffness of polypropylene increase, compared with unfilled polypropylene, and crystallization starts at higher temperatures. The resulting thermoformed parts have a better impact strength, higher elastic modulus (Young's modulus) and easier cooling phase.

The performance of the filler can be enhanced by addition of alpha or beta nucleating agents with different chemical structures. Examples of beta nucleating agents which can be advantageously used are: N,N'-dicyclohexyl-2,6-naphthalene dicarboxamide (NJ Star NU-100), Mayzo MPM 2000, Mayzo MPM 1113. Examples of alpha nucleating agents which can be advantageously used are: Sodium benzoate, Sorbitol acetal, Phosphate ester salt, Nonitol, Talc.

The nucleating agents, in particular beta nucleating agents, contribute to improve thickness homogeneity of the thermoformed parts.

The polypropylene-based material can also comprise additives, like antioxidant chemicals, lubricants, processing agents, and small percentages of other fillers.

For color purposes, the material can also contain titanium dioxide, for example in an amount of about 1 to 5% w/w, preferably about 3% w/w.

Exemplary embodiments of the material according to the invention contain from about 60% to about 90% w/w of (preferably random) PP co-polymer, from 0% to 25% w/w of homo-polypropylene and from about 10% to about 40% w/w of filler (talc).

In a preferred embodiment, the material comprises about 70% of (preferably random) PP co-polymer, 10% of homo-polypropylene and 20% of filler (talc).

The present invention also relates to a thermoforming method for manufacturing refrigerator liners (cabinet and door liners) by means of male molds, wherein the polypropylene-based materials previously described are used.

The invention related a refrigerator appliance having at least one internal liner, in particular a cabinet liner or a door liner, defining an inner compartment; wherein the liner is made of a polypropylene-based material comprising a propylene-ethylene copolymer having a main polypropylene chain with ethylene units arranged along the polypropylene chain; and at least one lamellar or fibrolamellar filler.

Preferably, the propylene-ethylene copolymer is a random copolymer, in which ethylenic units are inserted randomly with irregular patterns along a main polypropylene chain.

Preferably the polypropylene-based material contains at least 60% of propylene-ethylene copolymer.

More preferably, the polypropylene-based material comprises propylene-ethylene copolymer in an amount ranging between about 60 and about 90% w/w.

In an advantageous embodiment, the propylene-ethylene copolymer has a content of ethylene units ranging between about 1% and about 8% w/w.

More preferably, the propylene-ethylene copolymer has a content of ethylene units ranging between about 2% and about 5% w/w.

Advantageously the filler is selected in the group consisting of: talc, kaolin, mica, glass flakes, nanoclays, montmorillonite and bentonite, graphite, aluminum nitride, boron nitride.

More preferably the at least one lamellar or fibrolamellar filler is talc.

Preferably the filler comprises particles having a substantially platelet shape.

Preferably the polypropylene-based material contains one or more lamellar or fibrolamellar fillers in an amount ranging between about 10% and about 40% w/w.

More preferably the polypropylene-based material contains one or more lamellar or fibrolamellar fillers in an amount ranging between about 20% and about 30% w/w.

Advantageously the polypropylene-based material comprises also polypropylene homo-polymer.

Preferably the polypropylene-based material comprises also polypropylene homo-polymer in an amount ranging between about 0% and about 25% w/w.

More preferably the polypropylene-based material comprises also polypropylene homo-polymer in an amount ranging between about 1% and about 25% w/w.

Preferably the polypropylene-based material contains one or more alpha or beta nucleating agents.

The present invention also relates to a method for manufacturing a liner, in particular a cabinet liner or a door liner, of a refrigerator appliance; the method comprising the steps of:

preparing a polypropylene-based material comprising a propylene-ethylene copolymer having a main polypropylene chain with ethylene units arranged along the polypropylene chain; and at least one lamellar or fibrolamellar filler;

extruding the polypropylene-based material into sheets;

thermoforming a sheet of said polypropylene-based material onto a male mold to shape the liner.

Advantageously, in the method according to the invention the propylene-ethylene copolymer is a random copolymer, in which ethylenic units are inserted randomly with irregular patterns along a main polypropylene chain.

Advantageously, in the method according to the invention the polypropylene-based material contains at least 60% of propylene-ethylene copolymer.

Advantageously, in the method according to the invention the polypropylene-based material comprises propylene-ethylene copolymer in an amount ranging between about 60% and about 90% w/w.

Preferably, in the method according to the invention the propylene-ethylene copolymer has a content of ethylene units ranging between about 1% and about 8% w/w.

Advantageously, in the method according to the invention the propylene-ethylene copolymer has a content of ethylene units ranging between about 2% and about 5% w/w.

Advantageously, in the method according to the invention the filler is selected in the group consisting of: talc, kaolin, mica, glass flakes, nanoclays, montmorillonite and bentonite, graphite, aluminum nitride, boron nitride.

Preferably, in the method according to the invention, the filler is talc.

Advantageously, in the method according to the invention, the filler comprises particles having a substantially platelet shape.

Advantageously, in the method according to the invention, the polypropylene-based material contains one or more lamellar or fibrolamellar fillers in an amount ranging between about 10% and about 40% w/w.

Advantageously, in the method according to the invention, the polypropylene-based material contains one or more lamellar or fibrolamellar fillers in an amount ranging between about 20% and about 30% w/w.

Advantageously, in the method according to the invention, the polypropylene-based material comprises also polypropylene homo-polymer.

Advantageously, in the method according to the invention, the polypropylene-based material comprises also polypropylene homo-polymer in an amount ranging between about 0% and about 25% w/w.

More preferably, in the method according to the invention, the polypropylene-based material comprises also polypropylene homo-polymer in an amount ranging between about 1% and about 25% w/w.

Advantageously, in the method according to the invention, the polypropylene-based material contains one or more alpha or beta nucleating agents.

Advantageously, in the method according to the invention, the polypropylene-based material is prepared by compounding the propylene-ethylene copolymer and said at least one filler directly in an extruder during the extruding step.

Advantageously, in the method according to the invention, each sheet consists of a single, substantially uniform layer of the polypropylene-based material; or consists of a main layer, made of the polypropylene-based material, and of a glossy or semiglossy covering layer, covering a face of the main layer, made of neat polypropylene or a polypropylene compound with glossy appearance, said covering layer being co-extruded or laminated with the main layer.

Advantageously, in the method according to the invention, the thermoforming step comprises the steps of: heating the sheet to reach an operating temperature, at which the sheet is thermoformable; and shaping the sheet onto an outer shaping surface of the male mold.

Advantageously, in the method according to the invention, the operating temperature at which the sheet is thermoformable is between about 125° C. and about 155° C.

Advantageously, in the method according to the invention, the thermoforming step comprises, after the sheet has been heated, a pre-stretching step, in which the heated sheet is pre-stretched before being shaped onto the male mold.

Advantageously, in the method according to the invention, the sheet is vacuum formed onto the male mold.

Advantageously, in the method according to the invention, in the thermoforming step, vacuum is applied on the side of a first face of the sheet, facing the shaping surface of the male mold; and a compressed gas stream is injected on the side of a second face of the sheet, opposite to the first face.

Advantageously, in the method according to the invention, in the thermoforming step the shaping surface of the male mold is at a temperature lower than the recrystallization temperature of the polypropylene-ethylene copolymer.

Advantageously, in the method according to the invention, the temperature of the shaping surface is about 90-110° C.

Advantageously, the method according to the invention comprises a first cooling step effected on the formed sheet shaped to define the liner and still contacting the shaping surface of the male mold.

Advantageously, the method according to the invention, comprises a second cooling step effected after the liner has been removed from the male mold.

The invention is further described by way of example in the following non-limiting embodiments, with reference to the accompanying drawings in which.

Figure 6:
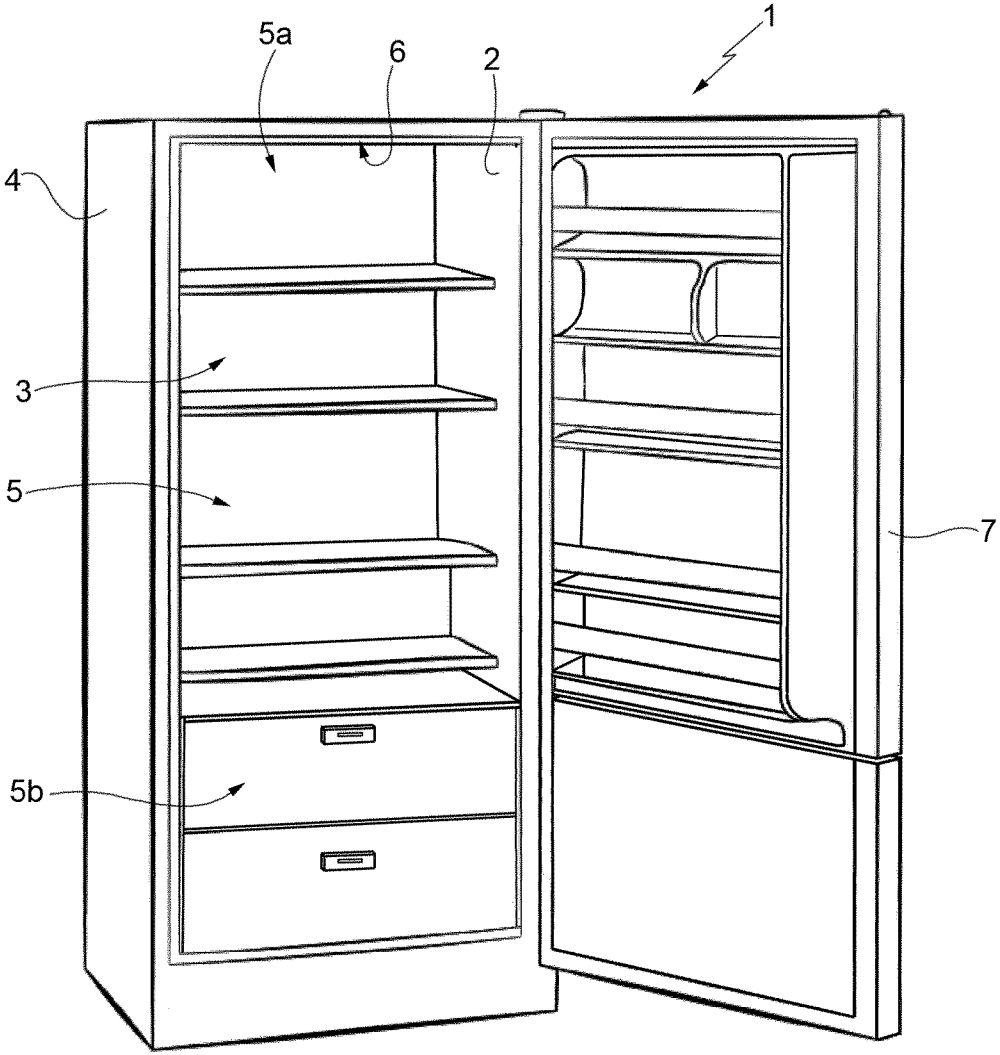
FIG. 6 is a simplified, schematic perspective view of a refrigerator appliance according to the invention.

In FIG. 6, it is indicated as a whole with reference numeral 1 a refrigerator appliance 1 having at least one inner plastic liner 2 defining at least one inner hollow compartment 3.

The appliance 1 comprises a hollow cabinet 4 internally provided with at least one cell 5, and having a front opening 6 closed by a door 7.

In the exemplary embodiment of FIG. 6, the appliance 1 is a combined fridge/freezer appliance and comprises a single cabinet 4 housing a refrigerator cell 5*a* and a freezer cell 5*b*, closed by respective doors 7.

Figure 1:
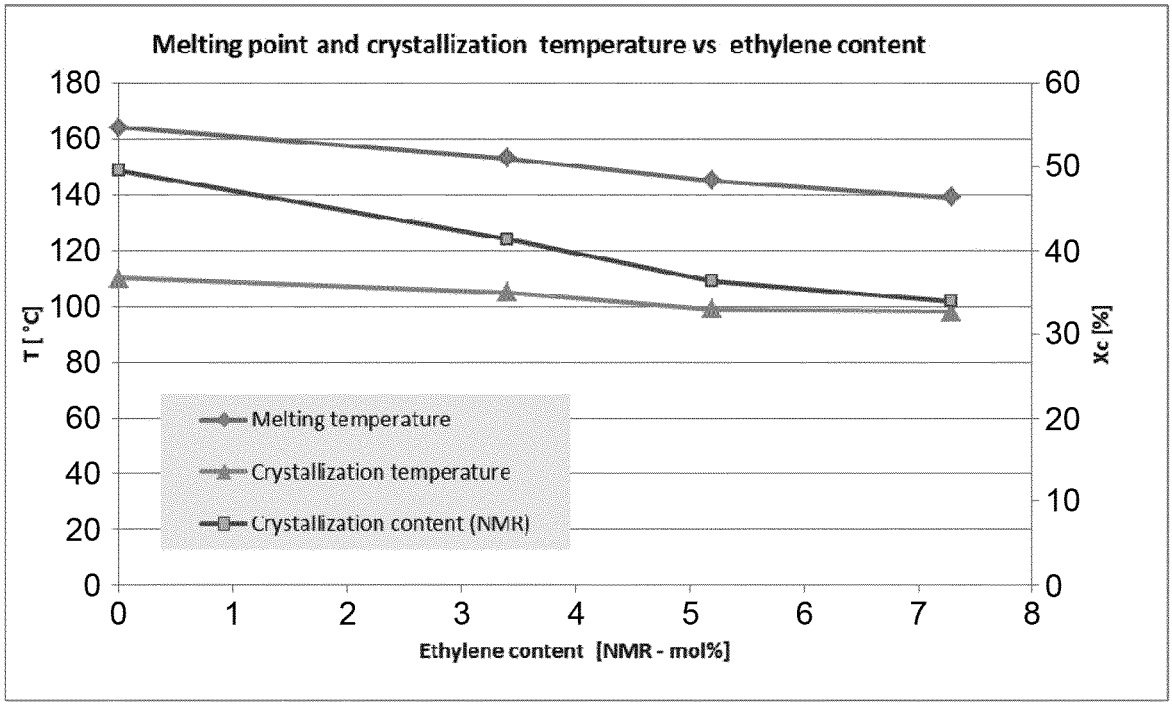
FIGS. 1 to 5 are diagrams showing different characteristics of materials used according to the invention with respect to prior art materials (as previously discussed)
Figure 2:
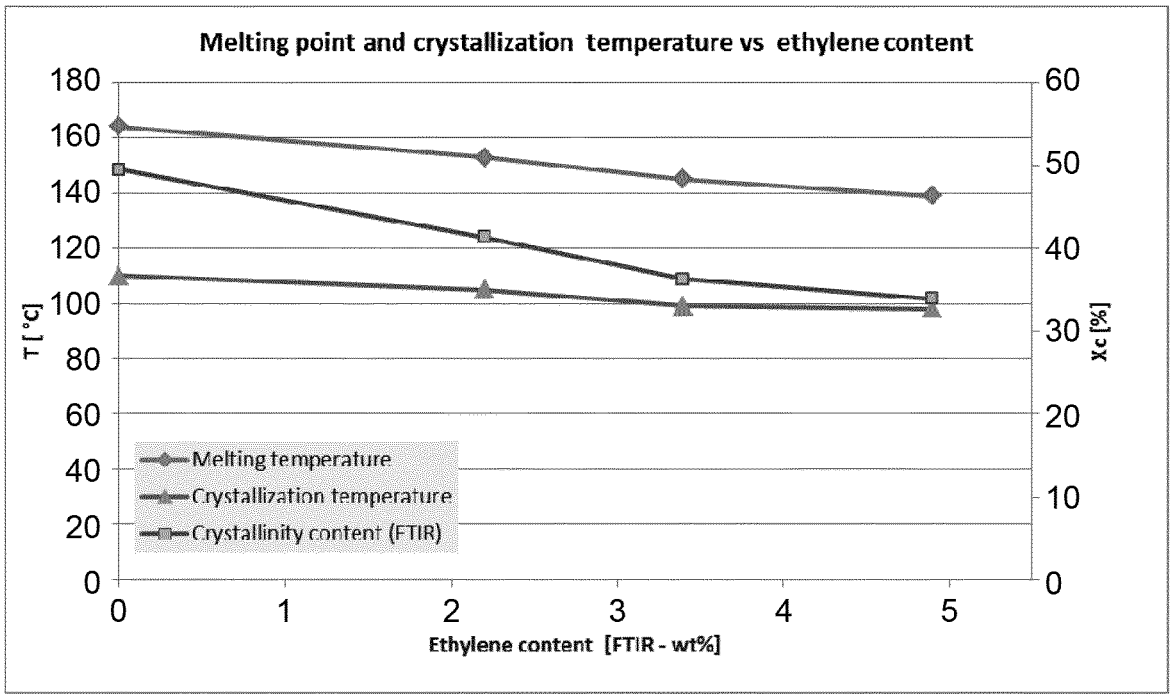
Figure 3:
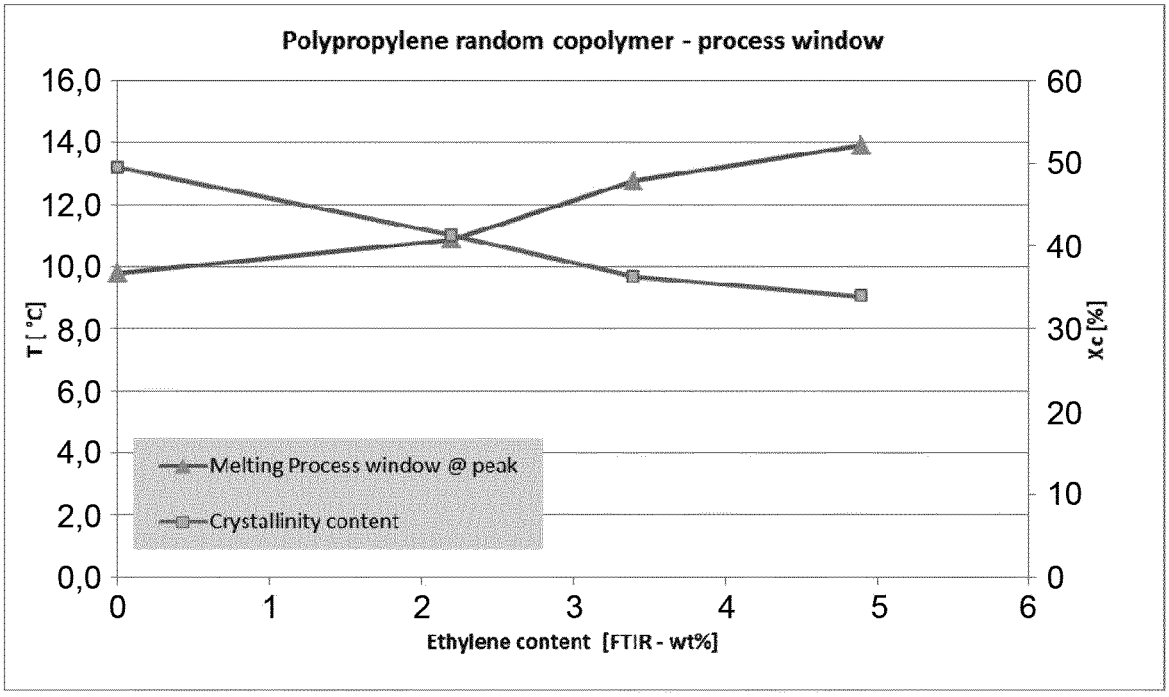
Figure 4:
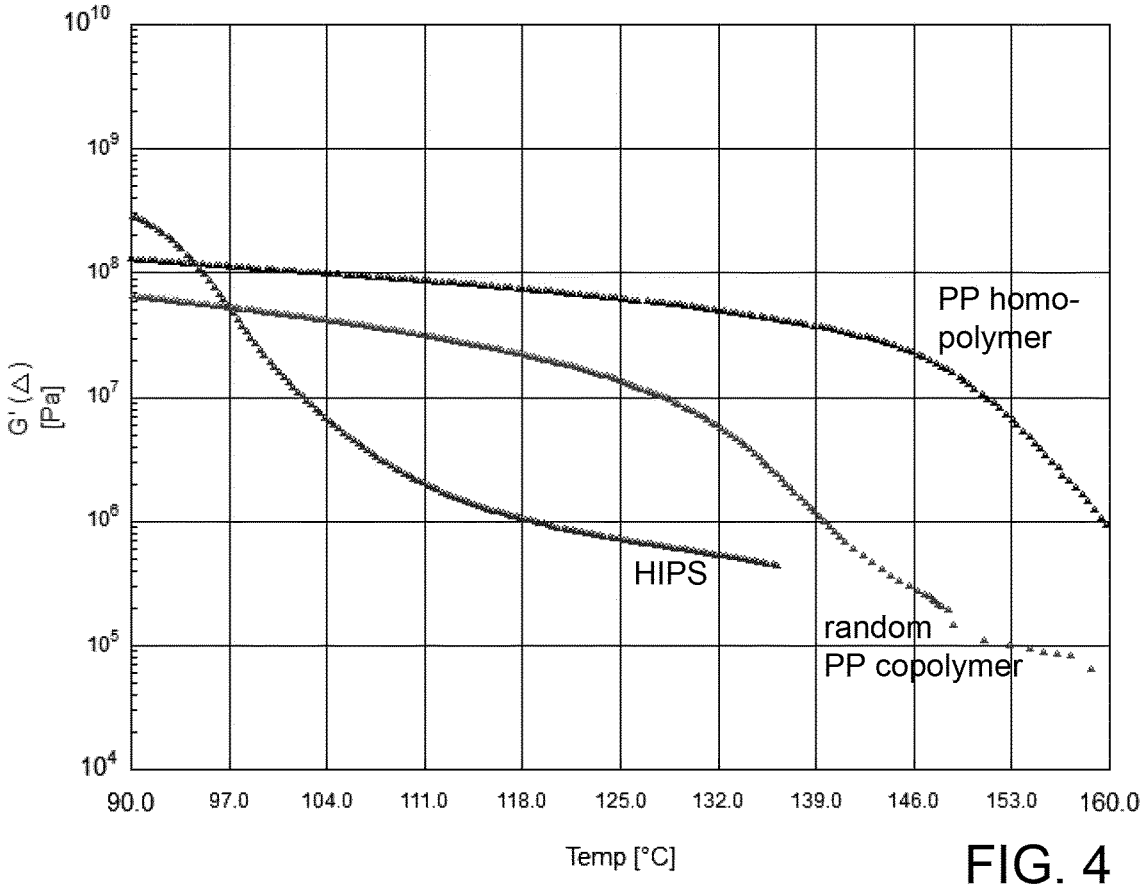
Figure 5:
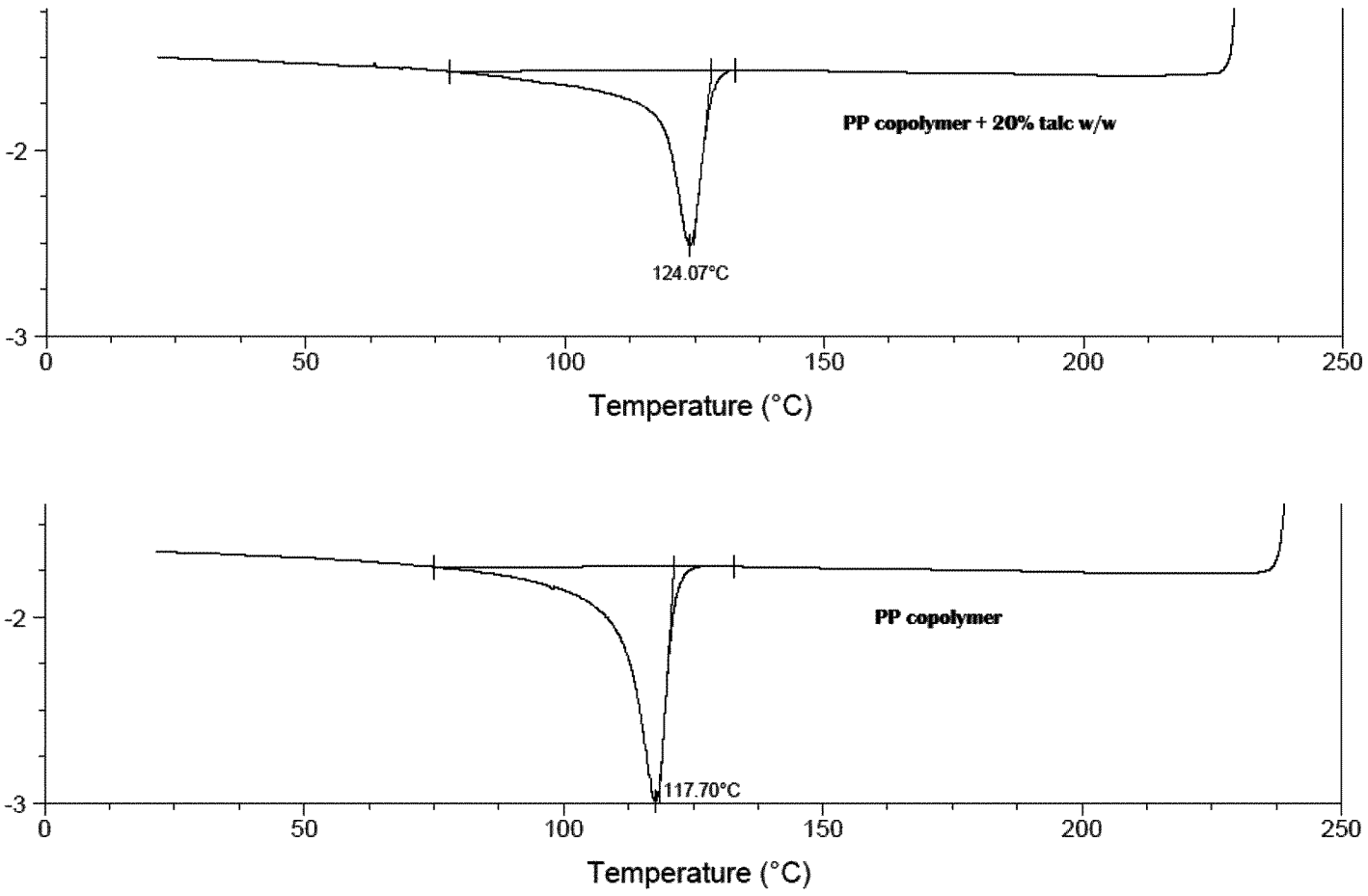
Figure 7:
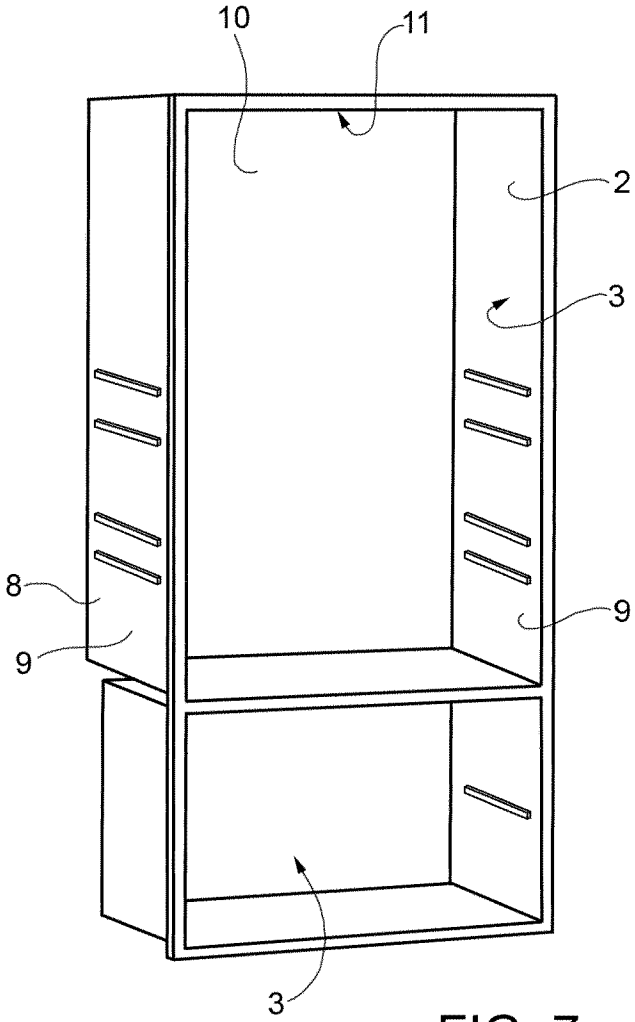
FIG. 7 is a schematic perspective view of a liner, in particular a cabinet liner, of the refrigerator appliance of FIG. 6.

With reference also to FIG. 7, the cells 5 are advantageously defined by respective compartments 3 of the liner 2, which in this case is advantageously a monolithic cabinet liner.

Hereinbelow, reference is made by way of example to a cabinet liner, but it is clear that the following description applies to any other liner, for example a single cell liner or a door liner, of a refrigerator appliance.

The liner 2 comprises a monolithic hollow body 8 shaped to define one or more (two, in the example of FIG. 7) compartments 3; each compartment 3 is advantageously delimited by lateral walls 9 projecting from a back wall 10 and has a front opening 11 opposite to the bottom wall 10.

The liner 2, i.e. the body 8, is made of a plastic (polymeric) material, in particular a polypropylene-based material.

In greater details, the liner 2 is made of a polypropylene-based material comprising a polypropylene copolymer (a copolymer in which propylene is the main component, i.e. having a content of propylene units greater than 50% w/w) containing ethylene units and compounded with at least one lamellar or fibrolamellar filler, for example and preferably talc.

In other words, the copolymer is a propylene-ethylene copolymer having a main polypropylene chain with ethylene units arranged along the polypropylene chain.

Advantageously, the copolymer has a content of ethylene units ranging between about 1% and about 8% w/w.

More advantageously, the copolymer has a content of ethylene units ranging between about 2% and about 5% w/w.

The polypropylene-based material also comprises at least one lamellar or fibrolamellar filler, i.e. one or more fillers having a lamellar or fibrolamellar structure; preferably this lamellar or fibrolamellar filler is talc.

As previously described, a lamellar or fibrolamellar filler is formed by thin particles having a substantially plate shape (i.e. a platelet or leaf shape).

The filler is preferably selected in the group consisting of: talc, kaolin, mica, glass flakes, nanoclays, montmorillonite and bentonite, graphite, aluminum nitride, boron nitride.

Advantageously, the polypropylene-based material contains one or more lamellar or fibrolamellar fillers in an amount ranging between about 5% w/w and about 40% w/w. More advantageously, the content of lamellar/fibrolamellar filler(s) ranges between about 10% and about 30% w/w.

The material optionally comprises the polypropylene-ethylene copolymer as a main component, and also homo-polypropylene (polypropylene homo-polymer), preferably in an amount ranging between about 0% and about 25% w/w. and more preferably in an amount ranging between about 0% and about 15% w/w.

Optionally, the material comprises additives, like antioxidant chemicals, lubricants, processing agents, and small percentages of other fillers; and/or titanium dioxide.

Figure 8:
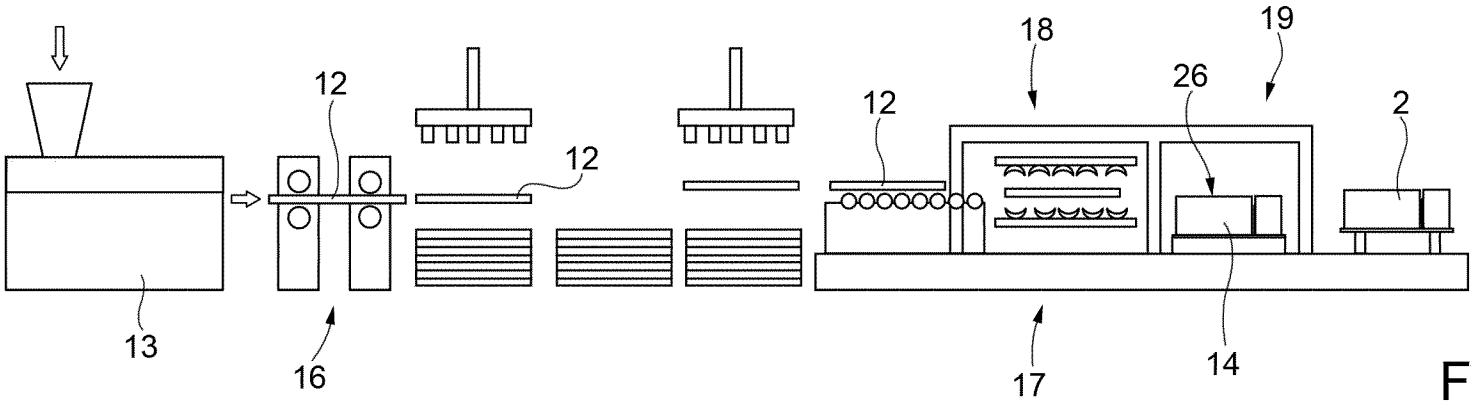
FIG. 8 is a schematic representation of the main steps of a method according to the invention for manufacturing the liner of FIG. 7, as well as other plastic liners of refrigerator appliances.

The liner 2 is advantageously manufactured by the method described hereinbelow with reference to FIGS. 8 to 10.

The manufacturing method of the invention advantageously comprises (FIG. 8) the steps of:

preparing the polypropylene-based material of the liner 2, advantageously by compounding the propylene-ethylene copolymer and at least one lamellar or fibrolamellar filler;

extruding the material into sheets 12, by using an extruder 13;

thermoforming a sheet 12 by means of a male mold 14 to shape the liner 2.

The polypropylene-based material and its components have been previously described.

In a preferred embodiment, the material is prepared directly in the extruding step: all the components, in particular the filler(s) and the PP copolymer (polypropylene-ethylene copolymer), are preferably compounded in the extruder 13. A twin-screw co-rotating extruder may be advantageously used.

However, some (or even all) components can also be pre-mixed in a mixing step before the extrusion step.

Figure 9:
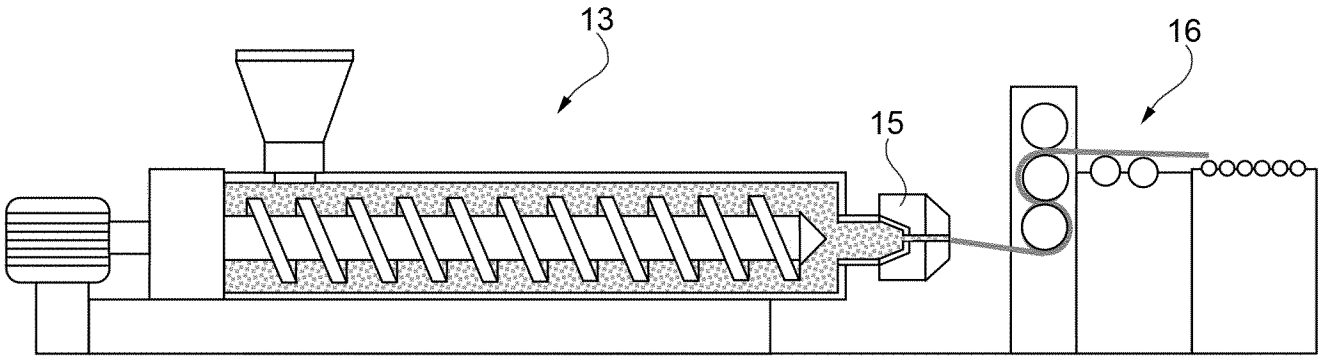
FIGS. 9 and 10 show in greater details some steps of the method according to the invention, in particular of an extrusion process and a thermoforming process which are part of the method of FIG. 8.

As shown in FIG. 9, the extruder 13 preferably has a plane dye 15 to produce a thin, flat planar flow.

Since the extruding process can generate, inside the material, internal stresses that can then be released at high temperature, during the following thermoforming process, it is advantageous to control the extruding process in order to obtain a nearly unoriented sheet; controlling of the extruding process is well known in the art, so it to will not be described in more details.

The extruded material which exit from the dye 15 is preferably pulled through a rolling unit 16, comprising a set of cooling rolls and a calender, where the material is cut into sheets 12, the sheets 12 are cooled and the final thickness of each sheet 12 is determined precisely. The sheets 12 are then preferably stacked.

Each sheet 12 comprises, and preferably consists of, a single, substantially uniform layer of the polypropylene-based material. In another advantageous embodiment, in order to improve the final product surface appearance, each sheet 12 comprises, and preferably consists of, a main layer, made of the above described polypropylene-based material, and a glossy or semiglossy covering layer, covering a face of the main layer and made of neat polypropylene or a PP compound with glossy appearance. Advantageously, the covering layer is co-extruded or laminated with the main layer.

Each individual sheet 12 is then supplied to a thermoforming section 17 (FIG. 8), comprising a heating unit 18 and a forming unit 19.

In the thermoforming section 17, the sheet 12 is first heated, for example by passing through the heating unit 18; and then shaped by thermoforming in the forming unit 19 to form the liner 2.

Figure 10:
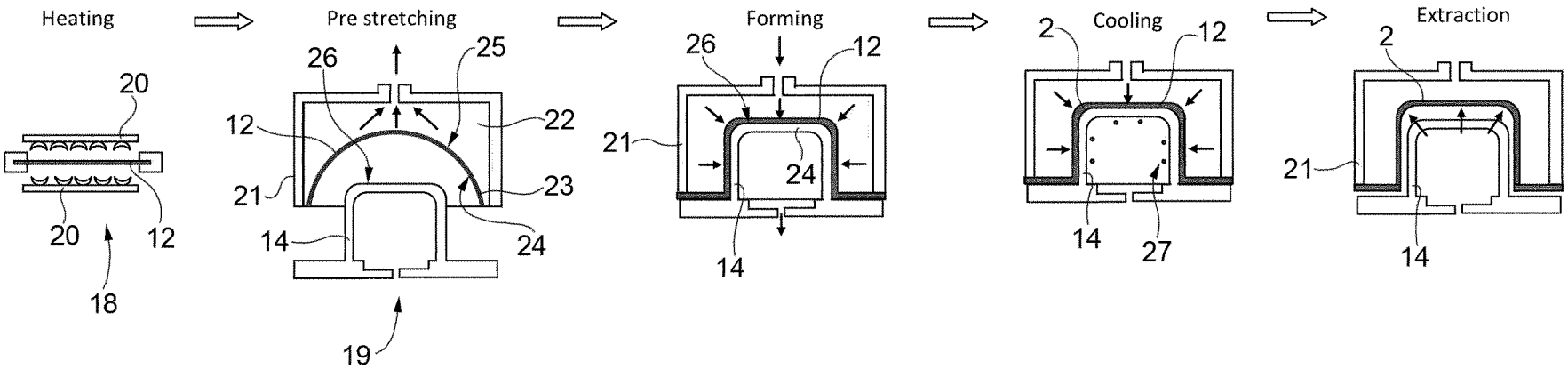

With reference also to FIG. 10, in the heating unit 18, the sheet 12 is heated to a predetermined operating temperature (forming temperature) at which the material is softened to a substantially rubbery state.

Advantageously, the operating temperature is between about 125° C. and about 155° C.

The sheet 12 is preferably advanced through the heating unit 18, having upper and lower heaters 20. The heaters 20 preferably (ma not necessarily) comprise infrared (IR) heating sources.

In order to reach a high efficiency, the heaters 20 have preferably an emission wavelength ranging between 2.9 and 4.2 microns (3450÷2380 cm-1), with the highest emission in the range 3.2÷3.8 microns (3125÷2630 cm-1), corresponding to the absorbing range for PP polymers.

Once the sheet material has reached the predetermined operating (forming) temperature, the material is in a substantially rubbery state and the heated, softened sheet 12 is moved to the forming unit 19, in particular inside a pressure box 21 or bell which houses the male mold 14, having the shape of the liner 2 to form.

For example, in the preferred embodiments of FIG. 10, the sheet 12 is positioned inside a vacuum chamber 22 of the pressure box 21 and the sheet 12 is advantageously clamped along its peripheral edge 23 in order to hold tightly the sheet 12. The clamped sheet 12 divides the vacuum chamber 22 of the pressure box 21 into two zones delimited by opposite faces of sheet 12: a first (inner) face 24, facing the male mold 14 and intended to define, after thermoforming, an inner surface of the liner 2; and a second (outer) face 25, opposite to the first face 24 and intended to define, after thermoforming, an outer surface of the liner 2.

Advantageously, in the pressure box 21 the sheet 12 is first subjected to a pre-stretching step, i.e. the sheet 12 is pre-stretched; and then the pre-stretched sheet 12 is vacuum formed onto the male mold 14.

For pre-stretching the sheet 12, vacuum is applied in the vacuum chamber 22 on the side of the second (outer) face 25 of the sheet 12.

For multi-cavity liners, such as combined cabinet liners for refrigerator and freezer, a double suction is advantageously performed and the sheet is blown into a so called "double bubble" (having two adjacent cavities) pre-stretching.

Once the sheet 12 is suitably pre-stretched, the male mold 14 is moved in the vacuum chamber 22 against the pre-stretched sheet 12, which is draped around an outer shaping surface 26 of the mold 14.

Advantageously, the mold 14 (in particular the shaping surface 26 thereof) is at a temperature lower than the recrystallization temperature of the PP copolymer. Preferably, the temperature of the mold 14 is about 90-110° C., for example around 100° C.

Vacuum is then applied on the side of the first face 24 of the sheet 12, for example through suitable inner channels in the mold 14, so as to draw the sheet 12 against the shaping surface 26 of the mold 14.

The differential pressure against the sheet 12 is amplified if the pressure inside the pressure box 21 is increased: thus, a compressed gas stream (air) can be advantageously injected in the pressure box 21, on the side of the second face 25 of the sheet 12, simultaneously with the vacuum (acting on the first face 24 of the sheet 12); in this way, it is possible to better replicate even small details on the shaping surface 26 of the mold 14. The sheet pre-stretching in combination with the forming pressure give a more uniform material distribution which is favorable to form complex geometries and undercuts.

Additional draft angles can be provided for very deep parts.

The sheet 12 adheres to the shaping surface 26 of the male mold 14 and assume the shape thereof.

The formed sheet 12, still contacting the shaping surface 26 of the mold 14, is then cooled to harden and form the liner 2, for example by blowing air onto the face 25 and/or by circulating a coolant in cooling conduits 27 inside the male mold 14.

Once sufficiently cooled, the sheet 12, having the shape of the liner 2, is separated from the male mold 14 (for example by blowing air through the inner channels of the male mold 14), and extracted from the pressure box 21.

The additional energy used in the heating step for softening the material should be removed efficiently in order to keep a pace corresponding to short production cycles. An additional cooling step can be added after extraction of the liner 2 from the thermoforming section 17 and it is very useful for thick thermoformed parts. Preferably, the warm rigid liner 2 is hence supplied to an additional cooling station (not shown) and cooled in order to reach a temperature that doesn't cause any further deformation; then the liner 2 is advantageously moved to a trimming and cutting unit (not shown) for removing edges and other scraps.

Clearly, further changes may be made to the refrigerator appliance and to the method for manufacturing the liner of the refrigerator appliance described herein without, however, departing from the scope of the present invention as defined by the enclosed Claims.

The invention claimed is:

1. A method for manufacturing an internal liner comprising a cabinet liner or a door liner of a refrigerator appliance, the method comprising the steps of:

preparing a polypropylene-based material comprising a propylene-ethylene random copolymer in an amount ranging between 60 and 90% w/w having a main polypropylene chain with ethylene units arranged along the polypropylene chain in an amount ranging between about 1% to about 8% w/w of the propylene-ethylene random copolymer, and at least one lamellar or fibrolamellar filler, and one or more alpha or beta nucleating agents;

extruding the polypropylene-based material prepared by compounding the propylene-ethylene copolymer and said at least one lamellar or fibrolamellar filler directly in an extruder into sheets; and thermoforming a sheet of said polypropylene-based material onto a male mold to shape the liner, wherein the thermoforming step comprises the steps of: heating the sheet to reach an operating temperature between 125° C. and 155° C., at which the sheet is thermoformable; and shaping the sheet onto an outer shaping surface of the male mold.

2. The method according to claim 1, wherein the propylene-ethylene copolymer has a content of ethylene units ranging between about 2% and about 5% w/w.

3. The method according to claim 1, wherein the at least one lamellar or fibrolamellar filler is selected from the group consisting of: talc, kaolin, mica, glass flakes, nanoclays, montmorillonite and bentonite, graphite, aluminum nitride, and boron nitride.

4. The method according to claim 3, wherein said at least one lamellar or fibrolamellar filler is talc.

5. The method according to claim 1, wherein the at least one lamellar or fibrolamellar filler comprises particles having a substantially platelet shape.

6. The method according to claim 1, wherein the polypropylene-based material contains the at least one lamellar or fibrolamellar filler in an amount ranging between 10% and 40% w/w.

7. The method according to claim 1, wherein the polypropylene-based material contains the at least one lamellar or fibrolamellar filler in an amount ranging between 20% and 30% w/w.

8. The method according to claim 1, wherein the polypropylene-based material further comprises polypropylene homo-polymer.

9. The method according to claim 1, wherein the polypropylene-based material further comprises polypropylene homo-polymer in an amount ranging between 0% and 25% w/w.

10. The method according to claim 1, wherein each sheet consists of a single, substantially uniform layer of the polypropylene-based material; or consists of a main layer, made of the polypropylene-based material, and of a glossy or semiglossy covering layer, covering a face of the main layer, made of neat polypropylene or a polypropylene compound with glossy appearance, said covering layer being co-extruded or laminated with the main layer.

11. The method according to claim 1, wherein the thermoforming step comprises, after the sheet has been heated, a pre-stretching step, in which the heated sheet is pre-stretched before being shaped onto the male mold.

12. The method according to claim 1, wherein the sheet is vacuum formed onto the male mold.

13. The method according to claim 12, wherein in the thermoforming step, vacuum is applied on the side of a first face of the sheet, facing the shaping surface of the male mold; and a compressed gas stream is injected on the side of a second face of the sheet, opposite to the first face.

14. The method according to claim 1, wherein in the thermoforming step the shaping surface of the male mold is at a temperature lower than a recrystallization temperature of the polypropylene-ethylene copolymer.

15. The method according to claim 14, wherein the temperature of the shaping surface is about 90-110° C.

16. The method according to claim 1, comprising a first cooling step effected on the sheet shaped to define the liner and still contacting the shaping surface of the male mold.

17. The method according to claim 16, comprising a second cooling step effected after the liner has been removed from the male mold.

* * * * *